United States Patent [19]

Joret

[11] 4,261,256

[45] Apr. 14, 1981

[54] AIR THROUGHPUT ADJUSTMENT DEVICE, NOTABLY FOR PAINT SPRAY CHAMBERS

[75] Inventor: Robert Joret, Angouleme, France

[73] Assignee: O.M.I.A., Angouleme, France

[21] Appl. No.: 45,265

[22] Filed: Jun. 4, 1979

[30] Foreign Application Priority Data

Jun. 9, 1978 [FR] France ..... 78 17267

[51] Int. Cl.[3] ..... B05C 15/00

[52] U.S. Cl. ..... 98/115 SB; 98/1.5

[58] Field of Search ..... 98/115 R, 115 LH, 115 SB, 98/1.5; 118/326; 417/38, 244

[56] References Cited

U.S. PATENT DOCUMENTS

| | | | |
|---|---|---|---|
| 2,297,495 | 9/1942 | Pfau | 98/1.5 X |
| 2,485,113 | 10/1949 | Roth et al. | 98/1.5 X |
| 3,168,030 | 2/1965 | Wilhelmsson | 98/115 SB |
| 3,397,716 | 8/1968 | Anderson | 417/38 |
| 3,656,866 | 4/1972 | Hinc, Jr. et al. | 417/38 |
| 3,820,627 | 6/1974 | Wirt | 98/115 R X |

FOREIGN PATENT DOCUMENTS

| | | | |
|---|---|---|---|
| 52-9961 | 1/1977 | Japan | 98/115 SB |

*Primary Examiner*—Albert J. Makay
*Assistant Examiner*—Harold Joyce
*Attorney, Agent, or Firm*—Wenderoth, Lind & Ponack

[57] ABSTRACT

A device for adjusting to a predetermined value the rate of flow of air introduced into an enclosed space having at least one inlet for introducing warm or cold air by means of a fan into the enclosed space includes structure for controlling the velocity of the air thus introduced into the enclosed space, structure for varying the velocity of rotation of the fan, at least one extractor for discharging the air from the enclosed space, and structure responsive to the pressure prevailing in the enclosed space for setting the extractor speed so that the removal of air from the enclosed space is adjusted automatically as a function of the predetermined volume of air introduced into the enclosed space.

3 Claims, 1 Drawing Figure

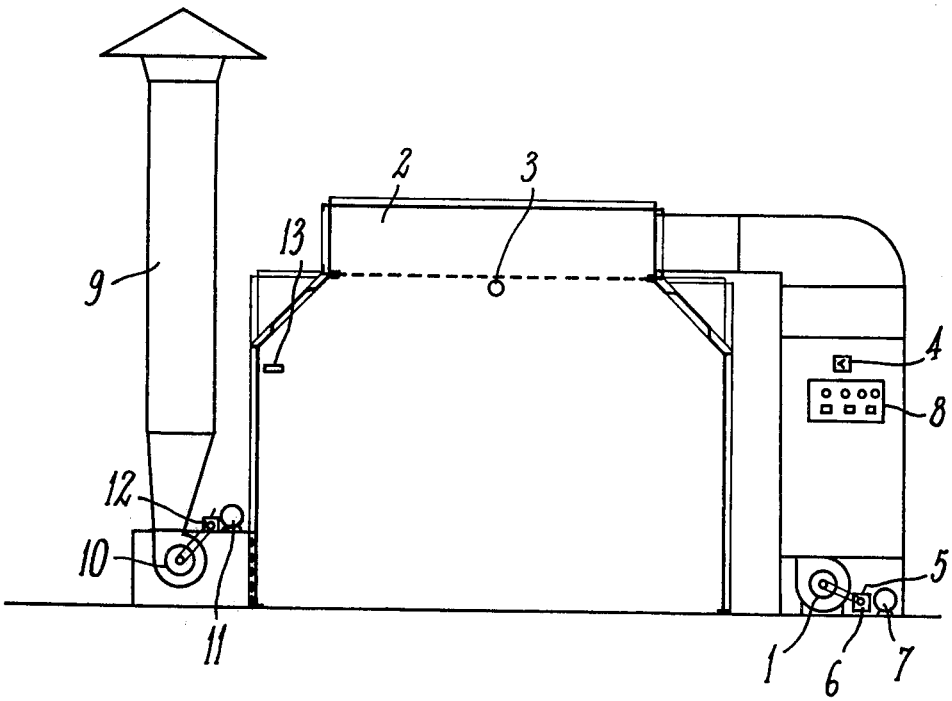
2
3
13
9
4
8
12
10
5
11
1
6
7

AIR THROUGHPUT ADJUSTMENT DEVICE, NOTABLY FOR PAINT SPRAY CHAMBERS

BACKGROUND OF THE INVENTION

Nowadays, various equipments, structures and articles, such as notably motor vehicles or the like, are painted inside so-called paint spray chambers or rooms constructed according to various requirements and conceptions. In modern plants the operator is placed inside the chamber and his protection is inadequate, so that he must wear a mask and this makes his task a particularly tedious and depressive one.

Under these difficult conditions the operator's safety is dependent upon the variable possibility of discharging the noxious solvents contained in the paints, since the vapors thereof spread throughout the paint room. To meet safety requirements, it is generally sufficient to provide a constant and adequate air flow through the room.

The standards concerning the requisite air flow rates have been set by safety authorities. However, up to now no paint chamber has been provided with means capable of adhering strictly to the official regulations notably in connection with air flow rates, with due consideration for the volume of the material or items to be painted or coated which is or are introduced into the chamber.

SUMMARY OF THE INVENTION

It is the essential object of this invention to provide a device capable of setting at a predetermined rate the velocity or flow rate of the air stream produced within a chamber, for example a paint chamber, this air flow velocity being adjusted, in this specific application, as a function of the dimensions of the material ( s ) to be coated.

To this end, the invention provides a device for adjusting to a predetermined value the flow rate of the warm or cold air introduced under pressure into a chamber by means of a fan, this device being characterized in that it comprises means for controlling the speed of the air stream introduced into the chamber, means for varying the fan speed, at least one extractor for removing the air from the chamber, and means for controlling the pressure in the chamber and so adjusting the extractor speed that the rate of extraction of air from the chamber is adjusted automatically as a function of the predetermined volume of air introduced into the chamber.

According to a specific characterising this invention, the means for controlling the speed of the air stream introduced into the chamber are inserted in the air flow circuit, the speed value being visible on the display dial of an indicator provided with pre-adjustment means operable as a function of the desired speed.

According to another feature of this invention, the pre-adjustment speed indicator controls directly and automatically a variator adapted to adjust the velocity of rotation of the inlet fan to the desired value.

BRIEF DESCRIPTION OF THE DRAWINGS

Other features and advantages of this invention will appear as the following description proceeds with reference to the attached drawing, of which the single FIGURE illustrates very diagrammatically by way of example a paint spray chamber equipped with the airflow rate control device of this invention.

DETAILED DESCRIPTION OF THE INVENTION

In the drawing, the paint spray chamber is an enclosed space into which the material or equipment to be coated, for example a motor vehicle or the like, is introduced. In this exemplary embodiment of the invention, the roof of the paint chamber is provided with a box-like extension 2 opening into the chamber and receiving warm or cold air forced by a fan 1. Of course, the box-like extension 2 of the chamber may be disposed at any other suitable location on the chamber. According to the invention, an air flow rate control apparatus 3 of any commercially available and suitable type is inserted in the air circuit, this apparatus being adapted to transmit the values of the speeds detected thereby to a display dial indicator 4 which has been pre-adjusted (pre-display) as a function of the desired air speed which, in this specific application, is dependent upon the volume of the material or item to be spray-coated in the chamber.

The inlet fan 1 is driven by a motor 7 through a variable-speed gear 6. In this specific embodiment given by way of illustration, not of limitation, a control lever 5 is provided for modifying at will and manually the fan rotational speed and set the latter at a value corresponding to the reference speed value pre-displayed on the dial of indicator 4.

Of course, it would not constitute a departure from this invention to provide means for automatically controlling the rotational speed of fan 1 by branching off the indicator dial a wire (not shown) leading to the control switchboard 8 for regulating the variable-speed gear 6 automatically and thus drive the fan 1 at the desired speed.

It will be seen that this result can be obtained with any desired chamber, whatever dimensions it may have. It is only necessary to provide one or more fans as well as one or a plurality of devices for controlling the speed or input of the air introduced into the enclosure.

From the foregoing, it appears clearly that with the device of this invention it is possible to adjust or control with maximum accuracy the velocity of the air introduced into the enclosure. Moreover, it is essential that this velocity be stable and to this end the present invention provides means for controlling the removal from the chamber of the air introduced by means of the input fan 1.

For this purpose, the present invention provides an extraction fan 10 driven by a motor 11 via a variable-speed gear 12 and taking air from the inner space of the chamber (in this application, this air contains solvent vapors) in order to discharge this air through a chimney 9. The device further comprises an apparatus 13 for constantly checking the pressure prevailing in the chamber. This apparatus 13 is so conceived and constructed as to control automatically and constantly the rotational speed of the outlet fan 10 through the variable-speed gear 12 or any other suitable means. Thus, the rate of extraction of the noxious air from the closed space can be adjusted as a function of the volume of air introduced into it. Of course, the variable-speed gear 12 may also be controlled manually through any suitable and known means.

The above-described result can be obtained with any desired chamber, room or enclosed space, irrespective of the size thereof. In fact, it is only necessary to fit on the chamber one or a plurality of extraction systems of the type disclosed herein-above, as a function of the volume of this enclosed space.

Of course, this invention should not be constructed as being strictly limited by the specific embodiment shown in the drawing and described hereinabove, since many modifications and changes may be made thereto without departing from the basic principles ofthe invention as set forth in the appended claims. Furthermore, this invention should not be regarded as being applicable only to paint spray chambers, since it is extremely useful whenever it is desired to control the rate of flow or speed of air any other gas.

What I claim is:

1. A painting structure comprising:

a painting cabin having therein an enclosed chamber for the receipt of material to be painted;

air inlet means opening into said chamber for introducing air thereinto;

fan means for pumpimng said air through said air inlet means into said chamber;

means for detecting the velocity of said air introduced into said chamber;

means for adjusting the rotational speed of said fan means for maintaining the volume and the velocity of said air introduced into said chamber at constant predetermined values as a function of the volume of said material to be painted within said chamber;

extractor means for removing said air from said chamber; and regulating means, operatively connected to said extractor means, for detecting the pressure within said chamber and for automatically controlling the operation of said extractor means as a function of said predetermined volume of said air introduced into said chamber.

2. A structure as claimed in claim 1, wherein said velocity detecting means is located in said air inlet means, and further comprising gauge means for displaying the value of velocity detected by said velocity detecting means and for presetting said predetermined air velocity value.

3. A structure as claimed in claim 2, wherein said adjusting means comprises a variable speed gear connected to said fan means and to said gauge means, and means incorporated in said gauge means, for automatically operatiing said variable speed gear for adjusting said rotational speed of said fan means.

* * * * *